US011136840B2

(12) United States Patent
Cates et al.

(10) Patent No.: US 11,136,840 B2
(45) Date of Patent: Oct. 5, 2021

(54) MULTIPLE PLATFORM SOLIDS TRANSFERRING AGGREGATE

(71) Applicant: HALLIBURTON ENERGY SERVICES, INC., Houston, TX (US)

(72) Inventors: Richard A. Cates, Church Point, LA (US); Lance Kim Windous, Denver, CO (US); Brian T. Abshire, Palisade, CO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 869 days.

(21) Appl. No.: 16/304,081

(22) PCT Filed: Jul. 22, 2016

(86) PCT No.: PCT/US2016/043745
§ 371 (c)(1),
(2) Date: Nov. 21, 2018

(87) PCT Pub. No.: WO2017/015631
PCT Pub. Date: Jan. 26, 2017

(65) Prior Publication Data

US 2021/0222502 A1 Jul. 22, 2021

Related U.S. Application Data

(60) Provisional application No. 62/195,390, filed on Jul. 22, 2015.

(51) Int. Cl.
*E21B 21/06* (2006.01)

(52) U.S. Cl.
CPC ..... *E21B 21/066* (2013.01)

(58) Field of Classification Search
CPC ..... E21B 21/065; E21B 21/066
See application file for complete search history.

(56) References Cited

U.S. PATENT DOCUMENTS 4,139,462 A 2/1979 Sample, Jr.
6,585,115 B1 * 7/2003 Reddoch ..... E21B 41/0057 209/3

(Continued)

FOREIGN PATENT DOCUMENTS

WO 2007060214 A2 5/2007

OTHER PUBLICATIONS

International Search Report and Written Opinion; PCT Application No. PCT/US2016/043745; dated Nov. 3, 2016.

(Continued)

*Primary Examiner* — Shane Bomar
(74) *Attorney, Agent, or Firm* — Polsinelli PC

(57) ABSTRACT

An apparatus including a superstructure comprising: a vacuum collection pod comprising a vessel with a first opening near the base, a second opening near the top of the vessel for a vacuum system, and a third opening near the top of the cylindrical vessel for a hose delivering solid and liquid materials; a rotary airlock valve coupled to the first opening; a vacuum system attached to the superstructure, wherein the inlet of the vacuum system is in fluid communication with the second opening near the top of the vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank. Methods of treating drill cuttings include the use of the apparatus.

27 Claims, 8 Drawing Sheets

(56) References Cited

U.S. PATENT DOCUMENTS

| | | | | |
|---|---|---|---|---|
| 7,207,399 | B2 * | 4/2007 | Duhe | C02F 1/20 175/66 |
| 7,306,057 | B2 * | 12/2007 | Strong | B01D 17/0211 175/66 |
| 7,490,672 | B2 * | 2/2009 | Hollier | E21B 21/065 166/357 |
| 7,629,497 | B2 * | 12/2009 | Pringle | B01J 19/20 585/241 |
| 10,226,720 | B2 * | 3/2019 | Vasshus | B01D 29/05 |
| 10,322,871 | B2 * | 6/2019 | Terry | B65D 88/72 |
| 10,655,300 | B2 * | 5/2020 | Hofland | E02F 3/9268 |
| 2003/0221331 | A1 | 12/2003 | Reddoch | |
| 2005/0153844 | A1 | 7/2005 | McIntyre | |
| 2005/0279715 | A1 | 12/2005 | Strong et al. | |
| 2006/0096119 | A1 * | 5/2006 | Schellstede | E21B 21/066 34/523 |
| 2007/0119628 | A1 * | 5/2007 | Reddoch, Sr. | E21B 21/066 175/66 |
| 2011/0315163 | A1 * | 12/2011 | Cates | B08B 9/0933 134/10 |
| 2014/0190904 | A1 * | 7/2014 | Sewell | E02F 3/9268 210/768 |
| 2020/0399966 | A1 * | 12/2020 | Kapila | E21B 21/066 |

OTHER PUBLICATIONS

International Preliminary Report on Patentability; PCT Application No. PCT/US2016/043745; dated Feb. 1, 2018.

* cited by examiner

MULTIPLE PLATFORM SOLIDS TRANSFERRING AGGREGATE

CROSS-REFERENCE TO RELATED APPLICATIONS

This application is a national stage entry of PCT/US2016/043745 filed Jul. 22, 2016, which claims the benefit of U.S. provisional application No. 62/195,390 filed Jul. 22, 2015, each of the said applications is expressly incorporated herein in its entirety.

BACKGROUND

Technology in connection with the exploration and production of hydrocarbon fluids, such as oil and gas, includes a variety of methods of drilling a wellbore into a formation to find and remove hydrocarbon fluids. During these drilling operations, drilling fluid is often pumped down through a drill pipe and into the wellbore through a drill bit, largely for the purposes of cleaning, lubricating, and cooling the drill bit. The drilling fluid mixes with sludge and cuttings (hereinafter referred to as "cuttings"), such as crushed rock and clay, before it is returned to the ground surface.

At the surface, the drilling fluid is typically separated from the cuttings and reused in the drilling process prior to disposal of the cuttings, especially when the drilling fluid includes oils or synthetic oils. However, this separation at the rig site may be inefficient with typical rig site solids control equipment such as shale shakers, hydrocyclones and centrifuges, and a significant amount of drilling fluid may remain associated with the cuttings.

Traditional methods of disposing the drill cuttings include dumping, bucket transport, conveyor belts, screw (auger) conveyors, and washing techniques that require large amounts of water. Adding water creates additional problems of added volume and bulk, pollution, and transport problems. Installing conveyors requires major modification to the rig area and involves extensive installation hours and expense. Auger conveyors also have additional wear and tear components and may pose a safety hazard due to the close proximity of rotating assemblies to the limbs of operators. In some instances, the cuttings, which are still contaminated with some oil, are transported from a drilling rig to an offshore rig or ashore in the form of a thick heavy paste or slurry for injection into an earth formation.

In certain areas, the levels of oil that remain associated with the cuttings exceeds the levels allowed for discharge overboard or disposal at industrial landfills, and some form of secondary treatment is required. Since the secondary treatment cannot be done at the rig site with conventional equipment, in many cases the cuttings are collected at the rig site and transferred to a vessel such as a container, box, skip, or the like, that is then transported to a secondary drilling waste treatment facility, where the cuttings are emptied from the transport vessel. The loading of the transport vessel is typically performed using a track hoe, which requires an operator.

Therefore, a need has arisen for an improved drill cutting treatment system requiring fewer operators and lower maintenance equipment.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

Figure 1:
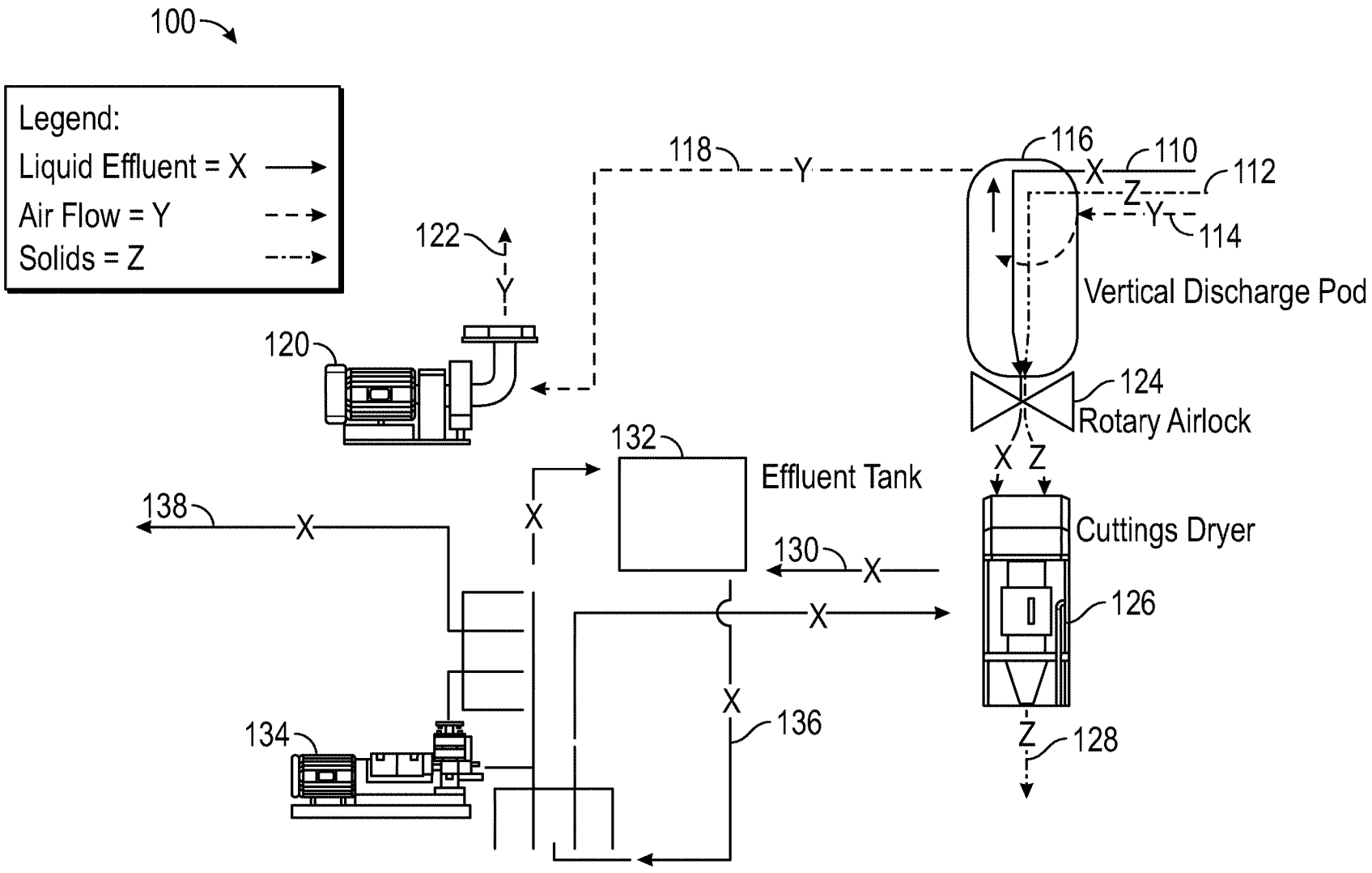
FIG. 1 is a process flow diagram according to aspects of the disclosure.

The disclosure is generally directed to the transportation of drill cuttings, and the separation of solids and liquids in the drill cuttings.

An apparatus may comprise a superstructure including: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank.

The superstructure may comprise a plurality of platforms, wherein each of the vacuum collection pod, rotary airlock valve, vacuum system, and solids separator is located on, or in close proximity to, at least one platform. In an embodiment, the superstructure comprises at least three platforms, wherein the vacuum collection pod and the rotary airlock are located on a first platform, the vacuum system is on a second platform, and the solids separator is located on a third platform. The apparatus may further comprise an extension vacuum pod between the vacuum system and the vacuum collection pod second opening, the extension vacuum pod comprising a cylindrical vessel with a conical bottom section and a fourth opening near the base of the cone, a fifth opening near the top of the extension vacuum pod cylindrical vessel configured to attach to the vacuum system, and a sixth opening near the top of the extension vacuum pod cylindrical vessel in fluid communication with and configured to receive material from the second opening of the vacuum collection pod. The apparatus may further comprise a hydraulic lifting system on the superstructure configured to raise at least one of the cylindrical vessel, the rotary airlock valve, and combinations thereof vertically from the solids separator. The superstructure may comprise telescoping stand legs allowing the adjustment of the height of the superstructure above the supporting surface. The apparatus may further comprise a pressure washer. The apparatus may further comprise a screen cleaner. The superstructure may be configured to accommodate a cuttings catch tank below the solids separator. The apparatus may further comprise a drop tank located in close proximity to the superstructure, wherein the drop tank comprises a cylindrical vessel with a conical bottom section and a seventh opening near the base of the cone, an eighth opening near the top of the drop tank cylindrical vessel configured to attach to the vacuum system, and a ninth opening near the top of the drop tank cylindrical vessel in fluid communication with and configured to receive material from the second opening of the vacuum collection pod.

A method of treating drill cuttings may comprise: receiving drill cuttings comprising solids and liquids into an apparatus including a superstructure, the apparatus comprising: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank; and separating solids and liquid effluent in the solids separator.

The method may further comprise at least one of drying the solids, pumping the effluent out of the effluent tank, and combinations thereof. The method may further comprise receiving material in an extension vacuum pod, wherein the apparatus further comprises an extension vacuum pod between the vacuum system and the vacuum collection pod second opening, the extension vacuum pod comprising a cylindrical vessel with a conical bottom section and a fourth opening near the base of the cone, a fifth opening near the top of the extension vacuum pod cylindrical vessel configured to attach to the vacuum system, and a sixth opening near the top of the extension vacuum pod cylindrical vessel in fluid communication with and configured to receive material from the second opening of the vacuum collection pod. The method may further comprise further comprising applying positive air pressure into the extension pod to offload the extension vacuum pod, wherein the apparatus further comprises a 4-way valve in fluid communication with the vacuum pump allowing the vacuum pump to discharge positive air pressure into the extension vacuum pod. The method may further comprise receiving material in a drop tank, wherein the apparatus further comprises a drop tank located in close proximity to the superstructure, wherein the drop tank comprises a cylindrical vessel with a conical bottom section and a seventh opening near the base of the cone, an eighth opening near the top of the drop tank cylindrical vessel configured to attach to the vacuum system, and a ninth opening near the top of the drop tank cylindrical vessel in fluid communication with and configured to receive material from the second opening of the vacuum collection pod.

The method may further comprise further comprise raising at least one of the cylindrical vessel, the rotary airlock valve, and combinations thereof vertically from the solids separator, wherein the apparatus further comprises a hydraulic lifting system on the superstructure configured to raise at least one of the cylindrical vessel, the rotary airlock valve, and combinations thereof vertically from the solids separator. The method may further comprise raising at least one of the cylindrical vessel, the rotary airlock valve, solids separator, and combinations thereof vertically, wherein the superstructure comprises telescoping stand legs allowing the adjustment of the height of the superstructure above the supporting surface. The method may further comprise cleaning a screen using a screen cleaner, wherein the apparatus further comprises a screen cleaner. The screen cleaner may be used to clean rig shaker screens. The method may further comprise depositing the separated solids into a cuttings catch tank, wherein the superstructure is configured to accommodate a cuttings catch tank below the solids separator. The method may further comprise further comprising placing the hose on the third opening near the top of the cylindrical vessel into a mud pit to remove material from the mud pit.

A method of cleaning mud pits may comprise: receiving drilling mud from mud pits, said mud comprising drill cuttings including solids and liquids, into an apparatus including a superstructure, the apparatus comprising: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank; and separating solids and liquid effluent in the solids separator. The method may further comprise returning the liquid effluent to an active drilling operation. The receiving of the drilling mud may be performed through a hose from the mud pit to the third opening near the top of the cylindrical vessel.

A drill cuttings treatment system may comprise: a drill cuttings treatment apparatus including a bulk solids transferring system, configured to collect and treat drill cuttings including: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank.

The following illustrative examples are given to introduce the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present disclosure.

Process Flow Diagram

FIG. 1 is a process flow diagram according to aspects of the disclosure and should not be limited to only the details shown in this example. The apparatus 100 of the disclosure receives drill cuttings including liquids 110, solids 112, and air 114, into a vacuum collection pod 116. The air 114 exits the vacuum collection pod 116 through a line 118 and travels to a vacuum unit 120, where it may later be discharged to atmosphere 122. The liquids 110 and solids 112 travel through a rotary airlock valve 124 and are delivered to a solids separator 126. The solids 112 are separated from the liquids 110 and are sent out of the solids separator 126 to a collection vessel 128. The liquids 110 are sent via line 130 to an effluent tank 132. Liquids 136 from the effluent tank 132 may be circulated for reuse using a centrifugal pump 134, or may be pumped to a different location 138 using the same centrifugal pump 134.

Multiple Platform Unit

Figure 2:
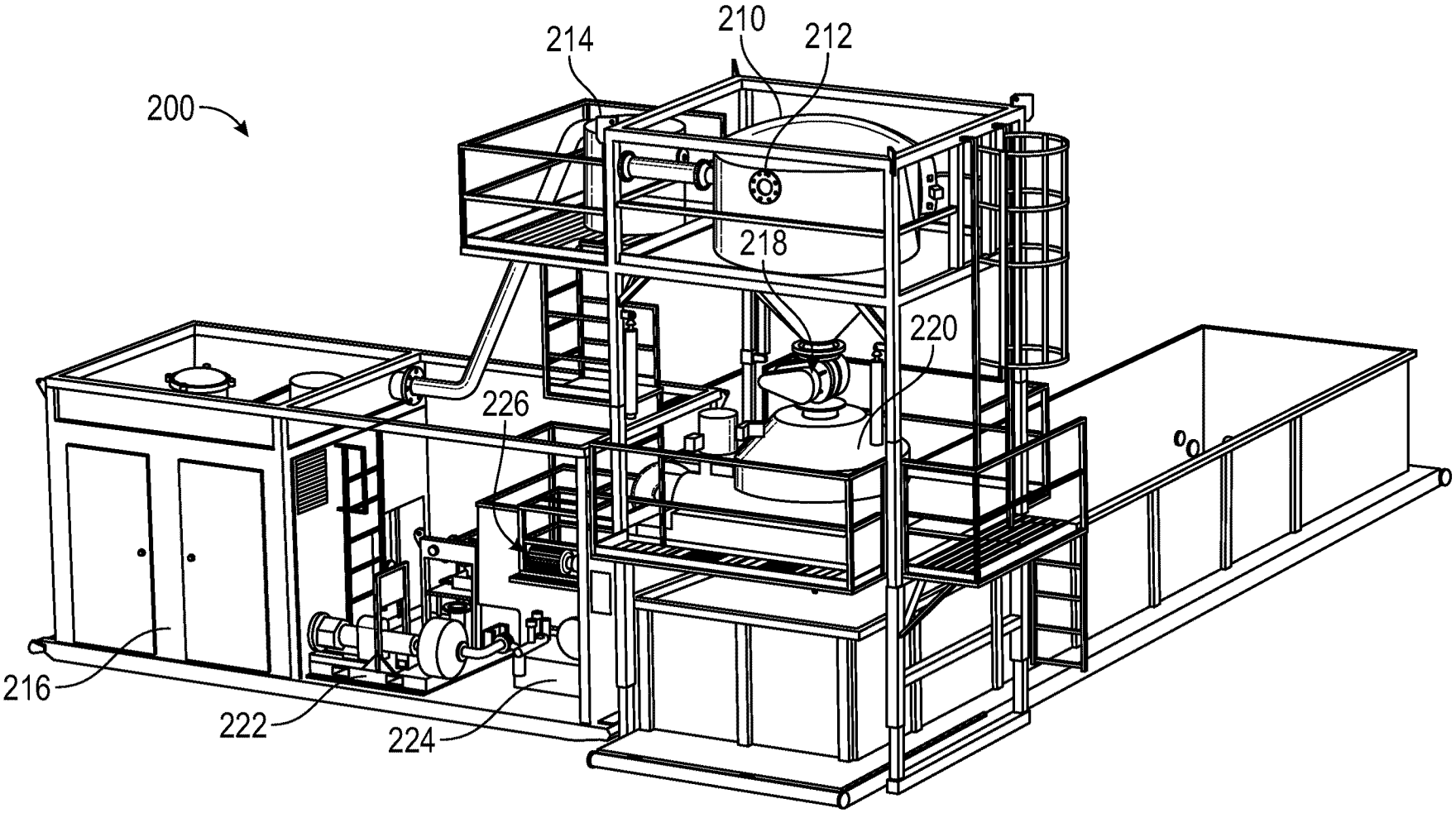
FIG. 2 is a drawing of a view of the multiple platform solids aggregate according to aspects of the disclosure.
Figure 3:
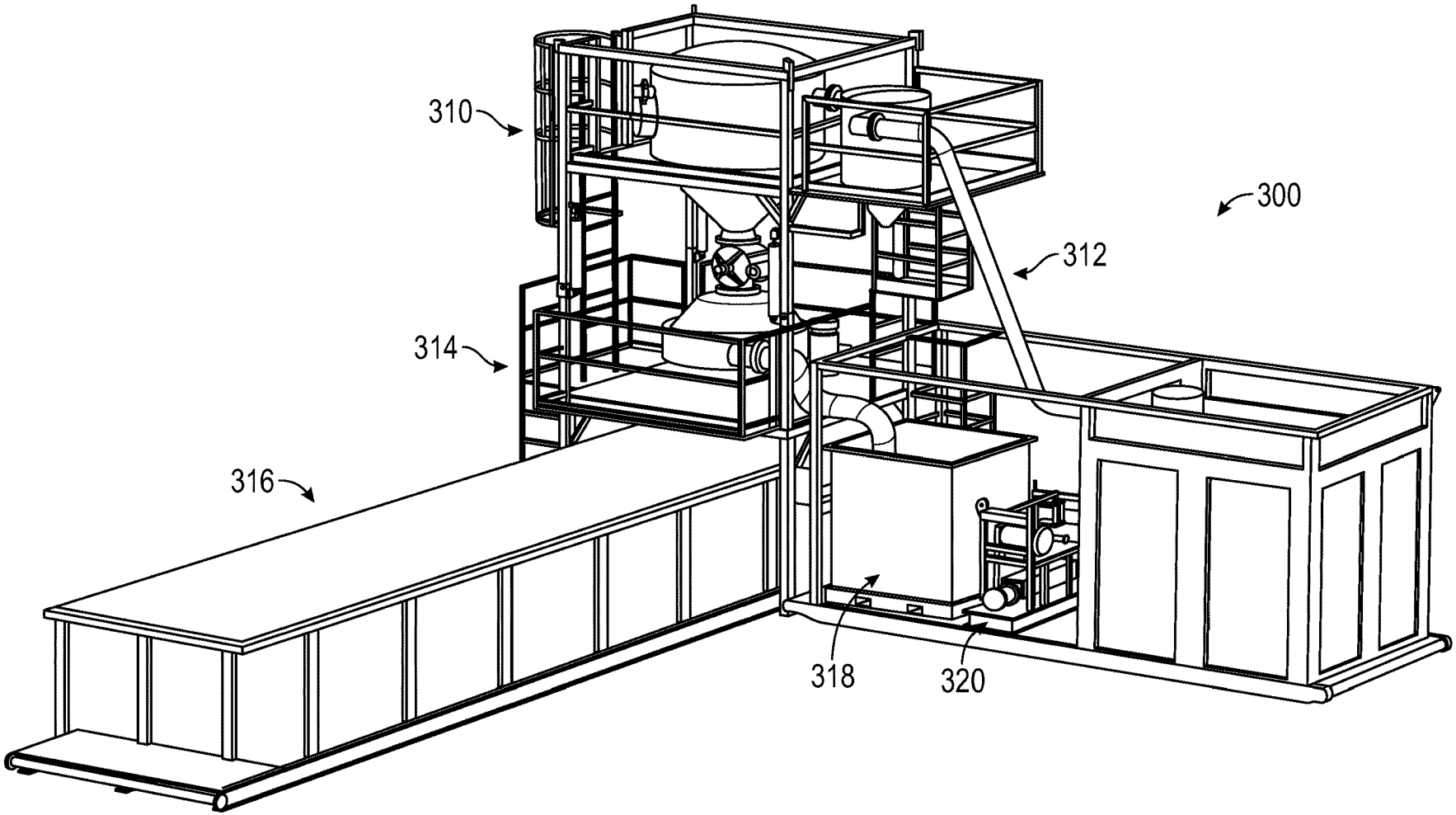
FIG. 3 is a drawing of a view of the multiple platform solids aggregate according to aspects of the disclosure.

The apparatus of the disclosure has components on different platforms based on function, ease of use, ease of maintenance, and combinations of all of these. FIGS. 2-3 show a non-limiting example of a multiple platform unit 200, 300. Vacuum collection pod 210 receives solids and liquids through a flange 212 to which a suction hose (not shown) may be connected. The vapors and possibly some mist and carryover liquids may travel to the optional extension vacuum pod 214, which may also be referred to as a site-spill response collection tank. One or both of these pods 212, 214 may be located on a pod platform 310. A vacuum unit 216 provides suction for the pods 212 and 214 through vacuum line 312. Attached to the bottom of the vacuum collection pod 210 is a rotary airlock valve 218. Solids and liquids travel through this valve 218 to a solids separator 220. The solids separator 220 may be located on a solids separator platform 314. Solids from the solids separator 220 may be placed into a cuttings catch tank 316. Liquids from the solids separator 220 may flow to an effluent tank 318. A centrifugal pump 222 may be used to pump the liquids out of the effluent tank 318. Additional equipment that may be present on the apparatus 200, 300 may include a hydraulic power pack 224, an electric screen cleaner 226, and an electric pressure washer 320. The pressure washer 320 may be used to clean the general work site area, and may additionally be used to clean rig shaker screens located in the vicinity.

Vacuum Collection Pod

Figure 4:
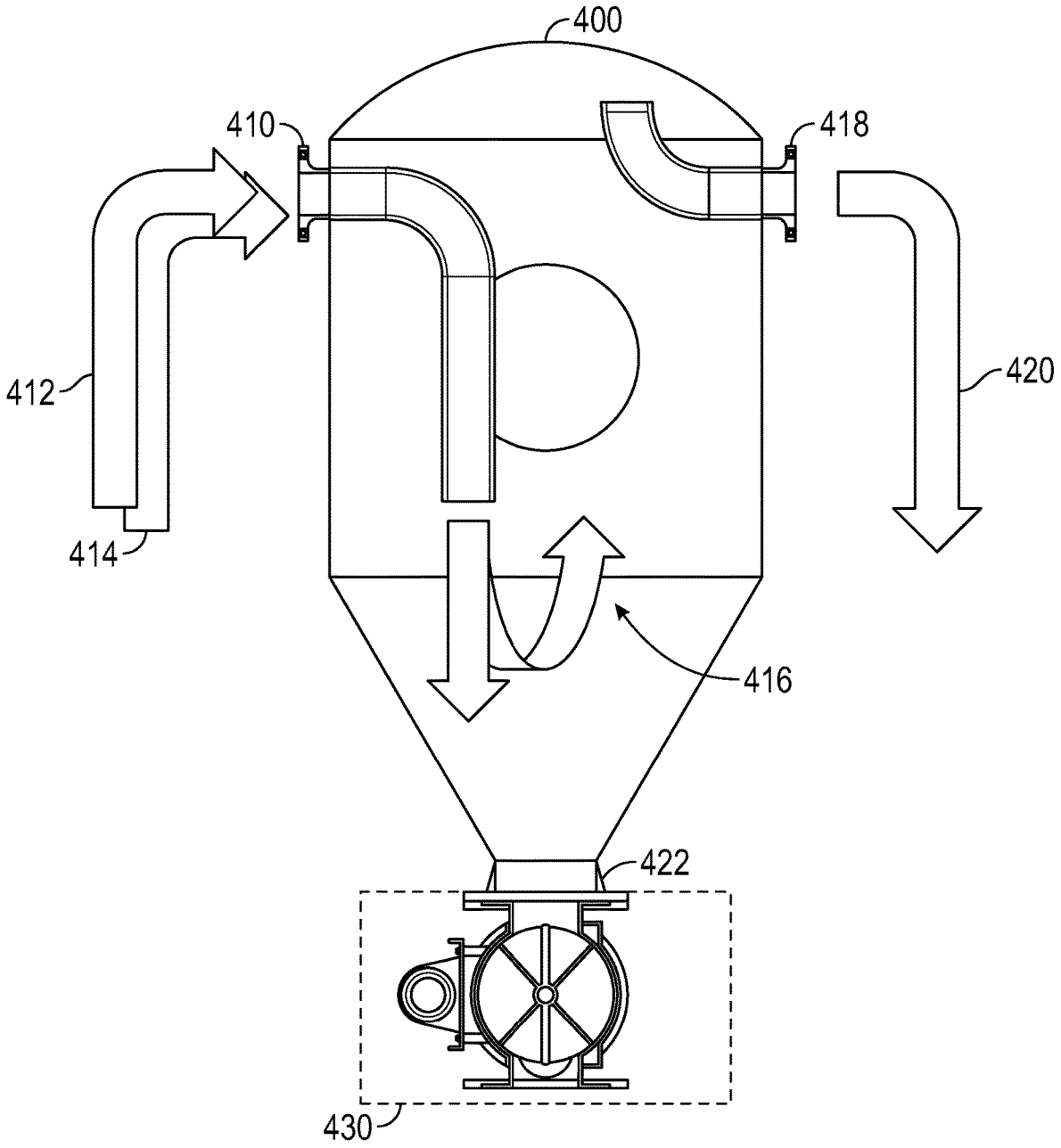
FIG. 4 is a drawing of a vacuum collection pod and rotary airlock valve according to aspects of the disclosure.

An important element of the apparatuses in the disclosure is a vacuum collection pod. As shown in FIG. 4, a vacuum collection pod 400 includes an inlet 410 to receive solids 412 and liquids 414 as well as air. The solids 412 and liquids 414 are separated from the air 416 by a vacuum line 418 that is attached to opening 416 near the top of the vacuum collection pod 400. The solids 412 and liquids 414 drop to the bottom of the vacuum collection pod 400 and exit through an opening 422 into a rotary airlock valve 430. A hose (not shown) may be connect to inlet 410 to facilitate sucking the solids and liquids into the vacuum collection pod 400.

As a non-limiting example, air, liquids, and solids may flow into the vacuum collection pod at a rate of about 150 feet/sec. As the solids and liquids drop out, the air slows to about 2-3 feet/sec and flows toward a vacuum unit operating at about 27 inches of Hg. The solids and liquids continue to a rotary airlock valve.

Rotary Airlock Valve

As shown in FIG. 4, a rotary airlock valve 430 is attached to the bottom opening 422 of the vacuum collection pod 400. The rotary airlock valve seals the vacuum collection pod, maintaining the vacuum necessary to draw solids and liquids into the vacuum collection pod. The rotary airlock valve, powered by a motor, steadily deposits an even flow of solids and liquids to the solids separator.

Vacuum System

The vacuum system 216 contains a "roots" type blower. As shown in FIG. 3, the vacuum system 216 may be mounted on a platform near the vacuum collection pod 210. The vacuum system should be sized such that a vacuum of sufficient strength is generated to move solids and liquids from the drilling rig to the vacuum collection pod and through an optional extension vacuum pod.

As a non-limiting example, a vacuum system with a 100 horsepower motor driving a "Roots" type blower may generate an air flow of 1750 actual cubic feet per minute. This is adequate to pull a 27 inch of Hg vacuum, drawing solids into the vacuum collection pod through a six-inch line at a rate of about 150 feet per second.

Solids Separator

Figure 5:
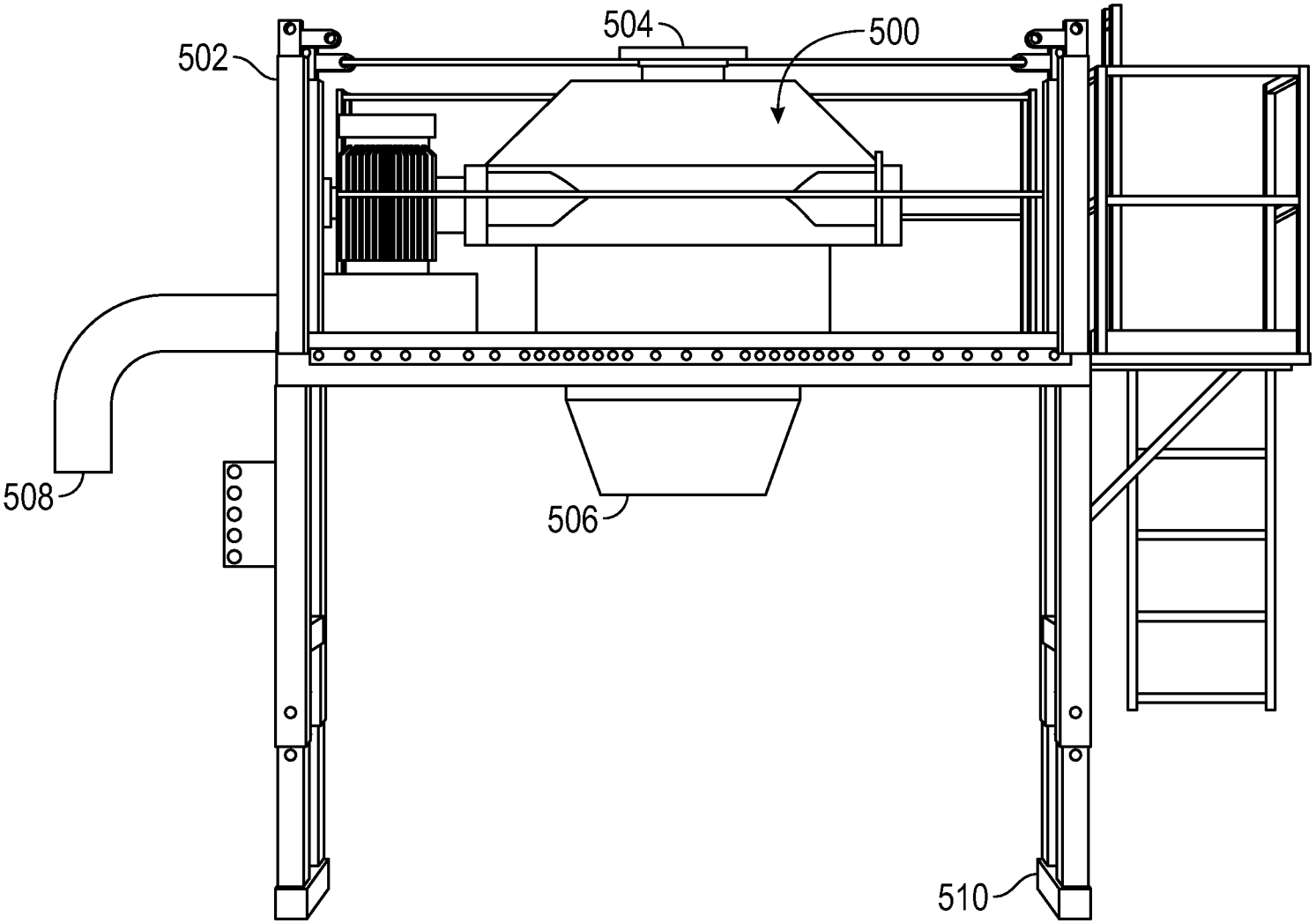
FIG. 5 is a drawing of the solids separator according to aspects of the disclosure.

As shown in FIG. 5, the apparatus includes a solids separator 500. This solids separator 500 may be mounted on a solids separator platform 502. The solids separator 500 includes an inlet 504 for receiving solids and liquids, a solids discharge port 506, and a liquids discharge port 508. The solids separator platform 502 may include telescoping stand legs 510, which allow the height of the solids separator platform 502 to be adjusted to accommodate various solids receiving vessels 316 as shown in FIG. 3.

Referring to FIGS. 2-3, solids separators 220 may be purchased as a complete unit and typically include a dryer 220, an effluent tank 318, and a centrifugal pump 224 for removing fluid from the effluent tank 318. The solids separators may also include a screen. The dryer typically uses centrifugal force to isolate solids and remove liquids from drill cuttings.

Extension Vacuum Pod/Drop Tank

The apparatus in the disclosure may include an optional extension vacuum pod useful for rig site spill cleanup and further preventing mists, carryover liquids, and carryover solids from the vacuum collection pod, from entering the vacuum system. As shown in FIGS. 2-3, extension vacuum pod 214 is located between vacuum system 216 and vacuum collection pod 210. The extension vacuum pod 214 may be located on the pod platform 310, or on a different platform. Extension vacuum pod 210 has two openings near the top, one of which is in fluid communication with the vacuum collection pod 210, and the other connected to a vacuum line leading to the vacuum system 216. There is also a discharge opening (not shown) at the bottom of the extension vacuum pod 210 that is used to empty the extension vacuum pod 210. The extension vacuum pod 214 may include an additional flange (not shown) near the top of the pod for a hose connection. This flange connection is typically smaller than the inlet from the vacuum collection pad, and may be connected to a small hose that may be run to the rig floor to use for site spill cleanups.

The vacuum extension pod may be used when the drill site location has cleaned the area with hydro-pressure washing or the cleanup is suspended in liquid form. The extension vacuum pod, also known as a rig vac extension pod, may be added to the vacuum collection pod to act as an intermediary catch tank. This extension vacuum pod may hold all material to be transferred, and may keep material from making its way to the vacuum system. Both the extension vacuum pod and the vacuum collection pod may be run simultaneously.

Material to be separated may be moved to the extension vacuum pod as a temporary holding tank. The vacuum system has a 4-way valve that may be turned to allow the vacuum pump to redirect positive air pressure into the extension vacuum pod, thereby offloading the pod.

Figure 6:
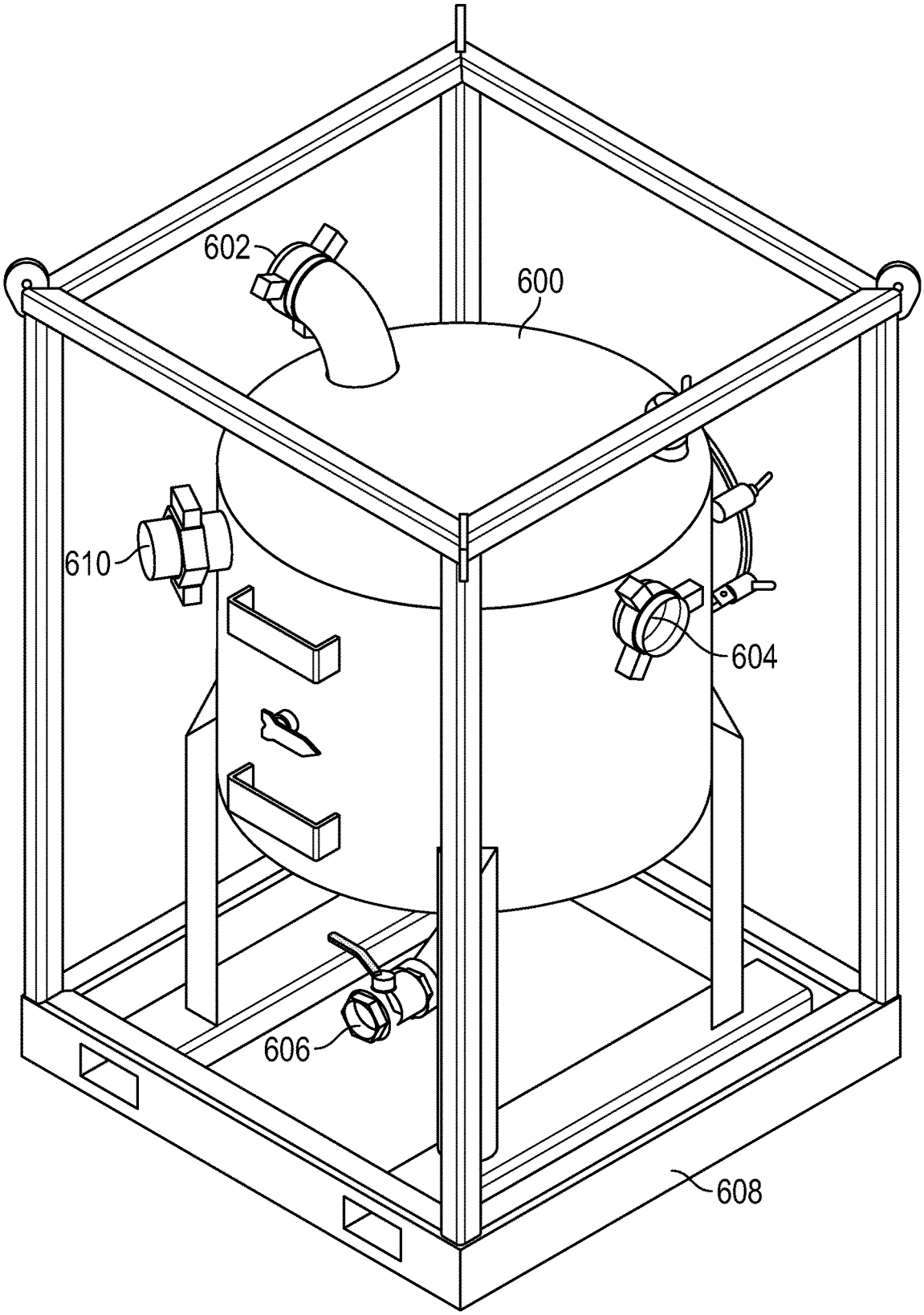
FIG. 6 is a drawing of a drop tank according to aspects of the disclosure.

The apparatus in the disclosure may also include a drop tank, which serves a similar function as the extension vacuum pod. The drop tank is located on the ground and may be added to an existing apparatus that does not contain an extension vacuum pod. As shown in FIG. 6, drop tank 600 includes an inlet 602 that is connected to the vacuum collection pod, and a vacuum system connection 604, that is connected to a vacuum line from the vacuum system. A discharge 606 at the base of the drop tank 600 may include a shut off valve, and is used for discharging the drop tank 600. The drop tank 600 may include an additional flange 610 for a hose connection. This flange connection 610 is typically smaller than the inlet connection 602 from the vacuum collection pad, and may be connected to a small hose that may be run to the rig floor to use for site spill cleanups. The drop tank 600 may be mounted on a portable skid 608, and may be located in close proximity to, or attached to, the superstructure including the vacuum collection pod. The drop tank may be used when it is too expensive to add a new platform, including an extension vacuum pod, to an existing superstructure apparatus.

Hydraulic Stand Lift

Figure 7:
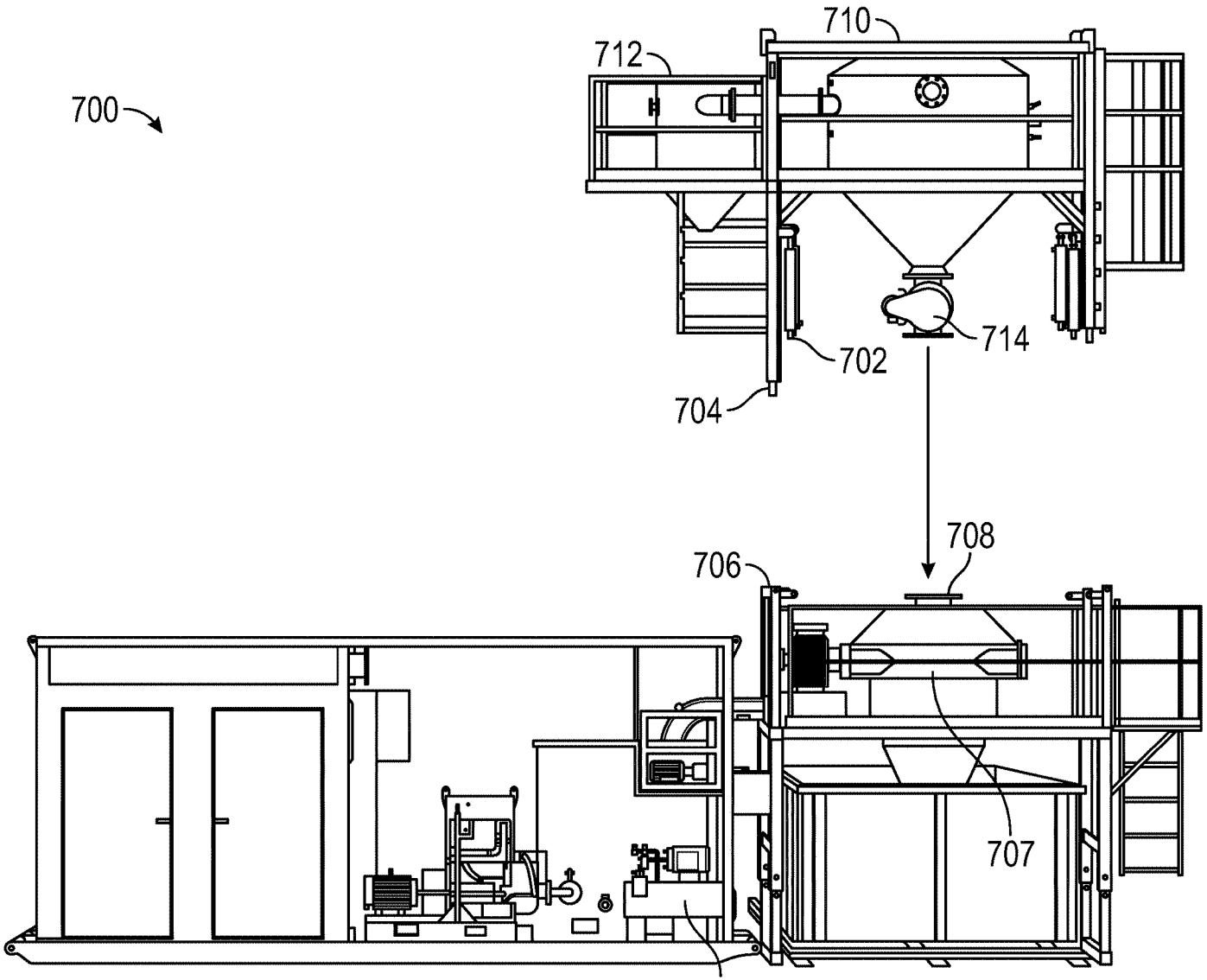
FIG. 7 is a drawing of the hydraulic stand lift system according to aspects of the disclosure.

The platform housing the vacuum collection pod may utilize a hydraulic lifting system powered by a hydraulic motor and power pack. As shown in FIG. 7, the hydraulic stand lift 700 includes hydraulic cylinders 702 mounted on a pod platform holding the vacuum collection pod 710, the rotary airlock valve 714, and the optional extension vacuum pod 712. The platform includes telescoping stand legs 704, which fit into the solids separator platform sleeves 706. To use the hydraulic lifting system 700, the rotary airlock valve 714 is unbolted from the solids separator flange 708, and the hydraulic cylinders 702, powered by a hydraulic power pack 724, lift the pod platform up allowing maintenance to be performed on the equipment, such as, the rotary airlock valve 714 or the solids separator 707. The hydraulic power pack 724 may be purchased as a unit and typically includes a tank for hydraulic fluid and a hydraulic pump and associated hoses to circulate the hydraulic fluid.

The hydraulic lifting system allows for ease of use during setup and maintenance. Using the hydraulic lifting system, the skid can be positioned in the proper setting needed to accommodate placement of various equipment placed below the vacuum collection pod. The vacuum collection pod can be lifted out of the way for maintenance periods as well. This may greatly reduce labor time needed for setup and normal maintenance of the equipment.

Screen Cleaner

As shown in FIG. 2, the apparatus may include an optional electric screen cleaner 226. The screen cleaner may be purchased as a unit and typically includes a cleaning wand and hose to spray liquid at a high pressure, and a pump. As a non-limiting example, an electric screen cleaner may provide 1.5 gallons per minute of liquid at 700 psi to clean screens located on the apparatus superstructure, or to clean rig shaker screens at the nearby rig.

Pressure Washer

As shown in FIG. 3, the apparatus may include an optional electric pressure washer 320. The pressure washer may be purchased as a unit and typically includes a cleaning wand and hose to spray liquid at a high pressure, and a pump. As a non-limiting example, an electric pressure washer may provide about 0 to 11 gallons per minute of liquid at about 0 to 3000 psi to clean the work area around the rig.

Other Equipment

The apparatus may include other equipment necessary to perform duties associated with the apparatus. As a non-limiting example, the apparatus may include a control system configured to monitor or control at least one of the level of material in the vacuum collection pod, fluid levels in the mechanical equipment, vacuum on filters, ancillary equipment tie-ins, and combinations thereof. A control panel may also be used to operate the equipment on the apparatus.

Use in and Around Wellbore

Figure 8:
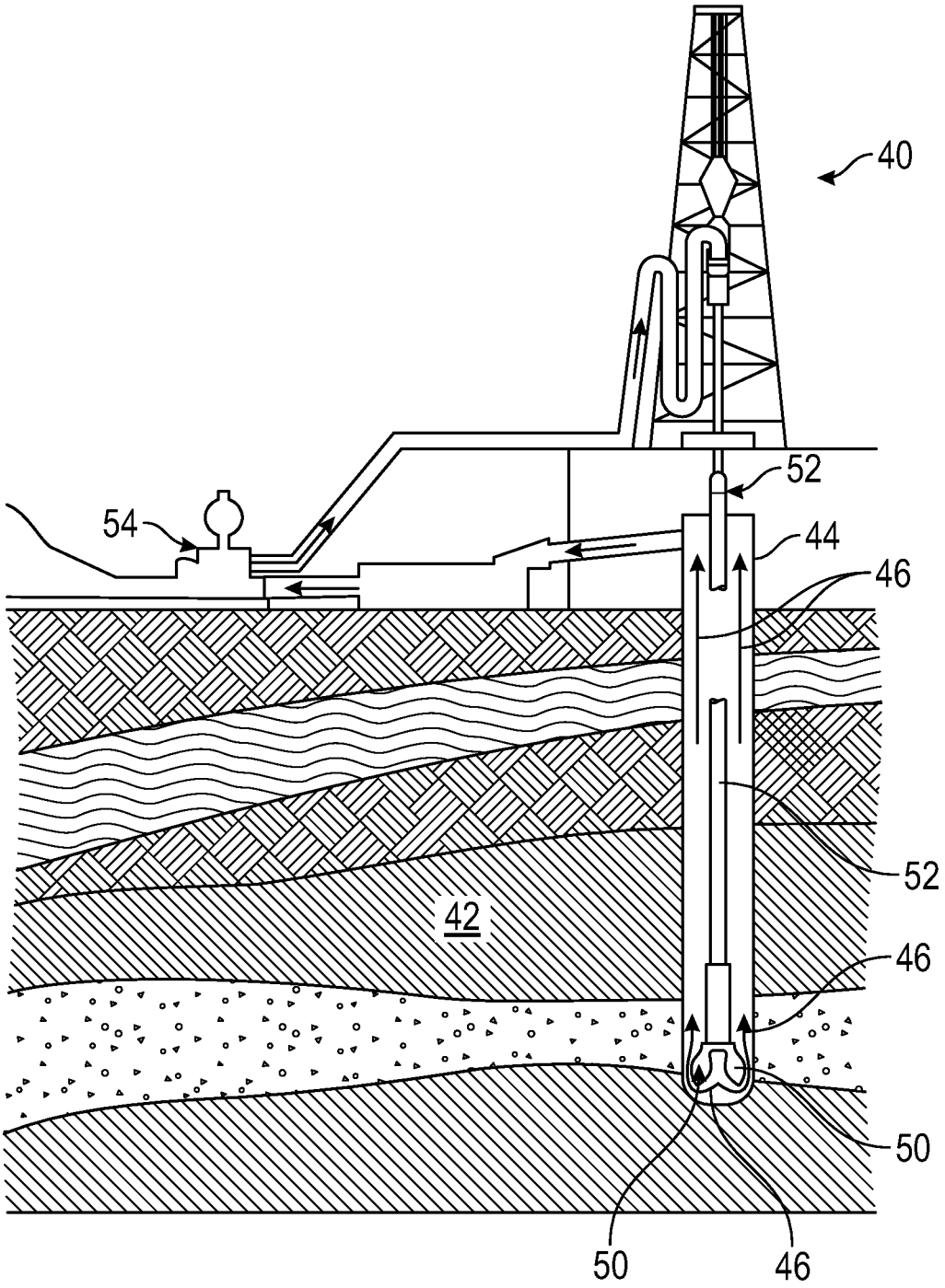
FIG. 8 is a drawing of a drilling well and the surrounding site according to aspects of the disclosure.

Referring to FIG. 8, a drill rig 40 for drilling a wellbore 44 that penetrates the earth 42 using a drilling fluid. A drill bit 50 may be mounted on the end of a drill string 52 comprising several sections of drill pipe. The wellbore 44 may be drilled by using a rotary drive at the surface to rotate drill string 52 and to apply torque and force to urge drill bit 50 to extend through wellbore 44. The drilling fluid may be displaced through drill string 52 using one or more pumps 54. The drilling fluid may be circulated past drill bit 50 and back to the surface as indicated by arrows 46, thereby removing drill cuttings from the wellbore (i.e., material such as rock generated by the drilling). These cuttings may be sent to a mud pit 56, where they are stored.

Utilizing the apparatuses disclosed above, the drill cuttings may be removed from the mud pit using a hose connected to the vacuum collection pod. The drill cuttings are processed by the solids separator into solids and liquids. The liquids are sent to an effluent tank where they may be transported offsite or returned to an active drilling site to be reused in ongoing drilling operations. This may also eliminate the need for a vacuum truck, and its associated expenses, to clean the mud pits.

The disclosed devices may directly or indirectly affect the various downhole equipment and tools that may come into contact with the sealing devices during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 8.

One of skill in the art will realize that there are several benefits to the superstructure apparatuses and methods of the disclosure. One benefit is the ability to eliminate augurs from the drill site when transporting cuttings from the rig. Additionally, the apparatuses may be used to clean mud pits during drilling operations, or after completion of the drilling operations. This may eliminate the need for a vacuum truck to clean the mud pits. Also, mud may be returned to an active drilling system after it has been processed through the apparatuses. Further, the apparatuses do not require the use of a track hoe and the associated operator when transporting drill cuttings, thereby possibly saving costs and possibly providing increased safety.

While preferred aspects of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Aspects disclosed herein include:

A: An apparatus comprising a superstructure including: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank.

B: A method of treating drill cuttings comprises: receiving drill cuttings comprising solids and liquids into an apparatus including a superstructure, the apparatus comprising: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank; and separating solids and liquid effluent in the solids separator.

C: A method of cleaning mud pits comprises: receiving drilling mud from mud pits, said mud comprising drill cuttings including solids and liquids, into an apparatus including a superstructure, the apparatus comprising: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank; and separating solids and liquid effluent in the solids separator.

D: A drill cuttings treatment system may comprise: a drill cuttings treatment apparatus including a bulk solids transferring system, configured to collect and treat drill cuttings including: a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system; a rotary airlock valve coupled to the first opening of the cylindrical vessel; a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank.

Each of aspects A, B, C, and D may have one or more of the following additional elements in any combination: Element 1: the superstructure comprises a plurality of platforms, wherein each of the vacuum collection pod, rotary airlock valve, vacuum system, and solids separator is located on, or in close proximity to, at least one platform. Element 2: wherein the superstructure comprises at least three platforms, wherein the vacuum collection pod and the rotary airlock are located on a first platform, the vacuum system is on a second platform, and the solids separator is located on a third platform. Element 3: further comprising an extension vacuum pod between the vacuum system and the vacuum collection pod second opening, the extension vacuum pod comprising a cylindrical vessel with a conical bottom section and a fourth opening near the base of the cone, a fifth opening near the top of the extension vacuum pod cylindrical vessel configured to attach to the vacuum system, and a sixth opening near the top of the extension vacuum pod cylindrical vessel in fluid communication with and configured to receive material from the second opening of the vacuum collection pod. Element 4: further comprising a hydraulic lifting system on the superstructure configured to raise at least one of the cylindrical vessel, the rotary airlock valve, and combinations thereof vertically from the solids separator. Element 5: wherein the superstructure comprises telescoping stand legs allowing the adjustment of the height of the superstructure above the supporting surface. Element 6: further comprising a pressure washer. Element 7: further comprising a control system configured to monitor or control at least one of the level of material in the vacuum collection pod, fluid levels in the mechanical equipment, vacuum on filters, ancillary equipment tie-ins, and combinations thereof. Element 8: further comprising a screen cleaner. Element 9: wherein the superstructure is configured to accommodate a cuttings catch tank below the solids separator. Element 10: further comprising a drop tank located in close proximity to the superstructure, wherein the drop tank comprises a cylindrical vessel with a conical bottom section and a seventh opening near the base of the cone, an eighth opening near the top of the drop tank cylindrical vessel configured to attach to the vacuum system, and a ninth opening near the top of the drop tank cylindrical vessel in fluid communication with and configured to receive material from the second opening of the vacuum collection pod. Element 11: further comprising drying the solids. Element 12: further comprising pumping the effluent out of the effluent tank. Element 13: further comprising receiving material in an extension vacuum pod, wherein the apparatus further comprises an extension vacuum pod between the vacuum system and the vacuum collection pod second opening, the extension vacuum pod comprising a cylindrical vessel with a conical bottom section and a fourth opening near the base of the cone, a fifth opening near the top of the extension vacuum pod cylindrical vessel configured to attach to the vacuum system, and a sixth opening near the top of the extension vacuum pod cylindrical vessel in fluid communication with and configured to receive material from the second opening of the vacuum collection pod. Element 14: further comprising applying positive air pressure into the extension pod to offload the extension vacuum pod, wherein the apparatus further comprises a 4-way valve in fluid communication with the vacuum pump allowing the vacuum pump to discharge positive air pressure into the extension vacuum pod. Element 15: further comprising receiving material in a drop tank, wherein the apparatus further comprises a drop tank located in close proximity to the superstructure, wherein the drop tank comprises a cylindrical vessel with a conical bottom section and a seventh opening near the base of the cone, an eighth opening near the top of the drop tank cylindrical vessel configured to attach to the vacuum system, and a ninth opening near the top of the drop tank cylindrical vessel in fluid communication with and configured to receive material from the second opening of the vacuum collection pod. Element 16: further comprising raising at least one of the cylindrical vessel, the rotary airlock valve, and combinations thereof vertically from the solids separator, wherein the apparatus further comprises a hydraulic lifting system on the superstructure configured to raise at least one of the cylindrical vessel, the rotary airlock valve, and combinations thereof vertically from the solids separator. Element 17: further comprising raising at least one of the cylindrical vessel, the rotary airlock valve, solids separator, and combinations thereof vertically, wherein the superstructure comprises telescoping stand legs allowing the adjustment of the height of the superstructure above the supporting surface. Element 18: further comprising cleaning a screen using a screen cleaner, wherein the apparatus further comprises a screen cleaner. Element 19: wherein the screen cleaner is used to clean rig shaker screens. Element 20: further comprising depositing the separated solids into a cuttings catch tank, wherein the superstructure is configured to accommodate a cuttings catch tank below the solids separator. Element 21: further comprising placing the hose on the third opening near the top of the cylindrical vessel into a mud pit to remove material from the mud pit. Element 22: further comprising returning the liquid effluent to an active drilling operation. Element 23: wherein the receiving of the drilling mud is performed through a hose from the mud pit to the third opening near the top of the cylindrical vessel.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

The invention claimed is:

1. An apparatus comprising a superstructure including:

a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solids and liquids from entering the vacuum system;

a rotary airlock valve coupled to the first opening of the cylindrical vessel;

a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank.

2. The apparatus of claim 1, wherein the superstructure comprises a plurality of platforms, wherein each of the vacuum collection pod, rotary airlock valve, vacuum system, and solids separator is located on, or in close proximity to, at least one platform.

3. The apparatus of claim 1, wherein the superstructure comprises at least three platforms, wherein the vacuum collection pod and the rotary airlock valve are located on a first platform, the vacuum system is on a second platform, and the solids separator is located on a third platform.

4. The apparatus of claim 1, further comprising an extension vacuum pod between the vacuum system and the vacuum collection pod second opening, the extension vacuum pod comprising a cylindrical vessel with a conical bottom section and a fourth opening near the base of the cone, a fifth opening near the top of the extension vacuum pod cylindrical vessel configured to attach to the vacuum system, and a sixth opening near the top of the extension vacuum pod cylindrical vessel in fluid communication with and configured to receive material from the second opening of the vacuum collection pod.

5. The apparatus of claim 1, further comprising a hydraulic lifting system on the superstructure configured to raise at least one of the cylindrical vessel, the rotary airlock valve, and combinations thereof vertically from the solids separator.

6. The apparatus of claim 1, wherein the superstructure comprises telescoping stand legs allowing the adjustment of the height of the superstructure above a supporting surface.

7. The apparatus of claim 1, further comprising a pressure washer.

8. The apparatus of claim 1, further comprising a control system configured to monitor or control at least one of the level of material in the vacuum collection pod, fluid levels in mechanical equipment, vacuum on filters, ancillary equipment tie-ins, and combinations thereof.

9. The apparatus of claim 1, further comprising a screen cleaner.

10. The apparatus of claim 1, wherein the superstructure is configured to accommodate a cuttings catch tank below the solids separator.

11. The apparatus of claim 1, further comprising a drop tank located in close proximity to the superstructure, wherein the drop tank comprises a cylindrical vessel with a conical bottom section and a fourth opening near the base of the cone, a fifth opening near the top of the drop tank cylindrical vessel configured to attach to the vacuum system, and a sixth opening near the top of the drop tank cylindrical vessel in fluid communication with and configured to receive material from the second opening of the vacuum collection pod.

12. A method of treating drill cuttings comprising:

receiving drill cuttings comprising solids and liquids into an apparatus including a superstructure, the apparatus comprising:

a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solid and liquid materials from entering the vacuum system;

a rotary airlock valve coupled to the first opening of the cylindrical vessel;

a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank; and separating solids and liquid effluent in the solids separator.

13. The method of claim 12, further comprising drying the solids.

14. The method of claim 12, further comprising pumping the effluent out of the effluent tank.

15. The method of claim 12, further comprising receiving material in an extension vacuum pod, wherein the apparatus further comprises an extension vacuum pod between the vacuum system and the vacuum collection pod second opening, the extension vacuum pod comprising a cylindrical vessel with a conical bottom section and a fourth opening near the base of the cone, a fifth opening near the top of the extension vacuum pod cylindrical vessel configured to attach to the vacuum system, and a sixth opening near the top of the extension vacuum pod cylindrical vessel in fluid communication with and configured to receive material from the second opening of the vacuum collection pod.

16. The method of claim 15, further comprising applying positive air pressure into the extension pod to offload the extension vacuum pod, wherein the apparatus further comprises a 4-way valve in fluid communication with a vacuum pump allowing the vacuum pump to discharge positive air pressure into the extension vacuum pod.

17. The method of claim 12, further comprising receiving material in a drop tank, wherein the apparatus further comprises a drop tank located in close proximity to the superstructure, wherein the drop tank comprises a cylindrical vessel with a conical bottom section and a fourth opening near the base of the cone, a fifth opening near the top of the drop tank cylindrical vessel configured to attach to the vacuum system, and a sixth opening near the top of the drop tank cylindrical vessel in fluid communication with and configured to receive material from the second opening of the vacuum collection pod.

18. The method of claim 12, further comprising raising at least one of the cylindrical vessel, the rotary airlock valve, and combinations thereof vertically from the solids separator, wherein the apparatus further comprises a hydraulic lifting system on the superstructure configured to raise at least one of the cylindrical vessel, the rotary airlock valve, and combinations thereof vertically from the solids separator.

19. The method of claim 12, further comprising raising at least one of the cylindrical vessel, the rotary airlock valve, solids separator, and combinations thereof vertically, wherein the superstructure comprises telescoping stand legs allowing the adjustment of the height of the superstructure above a supporting surface.

20. The method of claim 12, further comprising cleaning a screen using a screen cleaner, wherein the apparatus further comprises a screen cleaner.

21. The method of claim 20, wherein the screen cleaner is used to clean rig shaker screens.

22. The method of claim 12, further comprising depositing the separated solids into a cuttings catch tank, wherein the superstructure is configured to accommodate a cuttings catch tank below the solids separator.

23. The method of claim 12, further comprising placing the hose on the third opening near the top of the cylindrical vessel into a mud pit to remove material from the mud pit.

24. A method of cleaning mud pits comprising:

receiving drilling mud from mud pits, said mud comprising drill cuttings including solids and liquids, into an apparatus including a superstructure, the apparatus comprising:

a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose delivering solid and liquid materials, wherein the vacuum collection pod prevents at least a portion of the solid and liquid materials from entering the vacuum system;

a rotary airlock valve coupled to the first opening of the cylindrical vessel;

a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank; and separating solids and liquid effluent in the solids separator.

25. The method of claim 24, further comprising returning the liquid effluent to an active drilling operation.

26. The method of claim 24, wherein the receiving of the drilling mud is performed through a hose from the mud pit to the third opening near the top of the cylindrical vessel.

27. A drill cuttings treatment system comprising:

a drill cuttings treatment apparatus including a bulk solids transferring system, configured to collect and treat drill cuttings including:

a vacuum collection pod comprising a cylindrical vessel with a conical bottom section and a first opening near the base of the cone, a second opening near the top of the cylindrical vessel configured to attach to a vacuum system, and a third opening near the top of the cylindrical vessel configured to receive a hose containing drill cuttings, wherein the vacuum collection pod prevents at least a portion of the drill cuttings from entering the vacuum system;

a rotary airlock valve coupled to the first opening of the cylindrical vessel;

a vacuum system comprising an inlet, an outlet, and a blower, said vacuum system attached to the superstructure, wherein the inlet of the vacuum system is in fluid communication with the second opening near the top of the cylindrical vessel using a vacuum line; and a solids separator below the rotary airlock valve, the solids separator comprising a drill cuttings dryer, an effluent tank configured to collect effluent from the solids separator, and a centrifugal pump configured to remove the effluent from the effluent tank.

* * * * *